US005613173A

United States Patent [19]

Kunzmann et al.

[11] Patent Number: 5,613,173

[45] Date of Patent: Mar. 18, 1997

[54] BIASED ROLL CHARGING APPARATUS HAVING CLIPPED AC INPUT VOLTAGE

[75] Inventors: Brendan W. Kunzmann, Rochester; James D. Riehle, Webster; James M. Markovics, Rochester, all of N.Y.

[73] Assignee: Xerox Corporation, Stamford, Conn.

[21] Appl. No.: 577,893

[22] Filed: Dec. 22, 1995

[51] Int. Cl.[6] ..... G03G 15/00

[52] U.S. Cl. ..... 399/89; 361/221; 361/235

[58] Field of Search ..... 355/219, 274, 355/245; 361/221, 235

[56] References Cited

U.S. PATENT DOCUMENTS

| | | | |
|---|---|---|---|
| 4,466,732 | 8/1984 | Folkins | 355/245 |
| 4,673,280 | 6/1987 | Milton | 355/274 |
| 5,253,017 | 10/1993 | Takeda | 355/219 |
| 5,253,024 | 10/1993 | Okuda et al. | 355/282 |
| 5,412,455 | 2/1995 | Ono et al. | 355/219 |
| 5,463,450 | 10/1995 | Inoue et al. | 355/219 |

*Primary Examiner*—William J. Royer
*Attorney, Agent, or Firm*—Denis A. Robitaille

[57] ABSTRACT

An apparatus for applying an electrical charge to a charge retentive surface, wherein a bias contact roll member is situated in contact with a surface of the photoreceptor. The bias contact roll member is supplied with an electrical bias including an oscillating voltage signal having a DC offset, wherein the oscillating voltage is clipped via a rectifier circuit to remove a predetermined polarity component thereof.

18 Claims, 3 Drawing Sheets

BIASED ROLL CHARGING APPARATUS HAVING CLIPPED AC INPUT VOLTAGE

Figure 1:
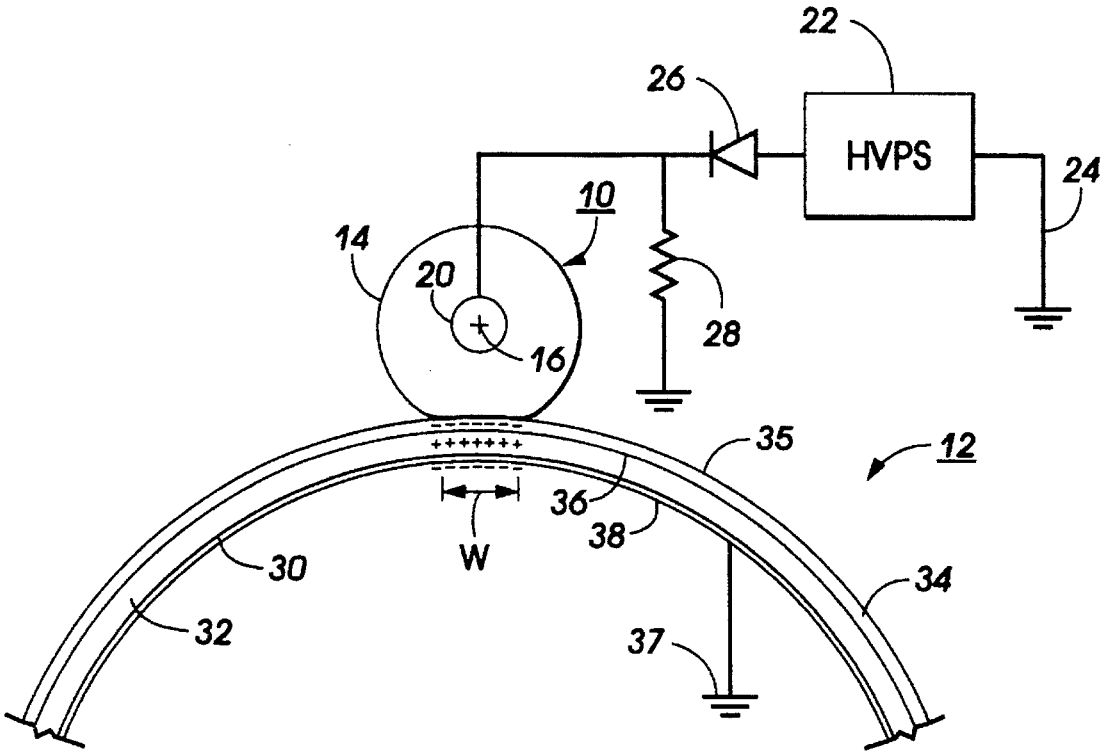

The present invention relates generally to an apparatus for generating a substantially uniform charge on a surface, and, more particularly, concerns a biased roll charging apparatus having a clipped AC input voltage, primarily for use in electrostatographic applications, for example, to charge an imaging member such as a photoreceptor.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam where charge is removed from a charged photoconductive surface in response to electronically generated or stored images. Some of these printing processes develop toner on the discharged area, known as DAD, or "write black" systems, in contradistinction to the light lens generated image systems which develop toner on the charged areas, known as CAD, or "write white" systems. The subject invention applies to both DAD or CAD systems.

Various devices and apparatus have been proposed for creating a uniform electrostatic charge or charge potential on a photoconductive surface prior to the formation of the latent image thereon. Generally, corona generating devices are utilized to apply a charge to the photoreceptive member. In a typical device, a suspended electrode, or so-called coronode, comprising a thin conductive wire is partially surrounded by a conductive shield with the device being situated in close proximity to the photoconductive surface. The coronode is electrically biased to a high voltage potential, causing ionization of surrounding air which results in the deposit of an electrical charge on an adjacent surface, namely the photoconductive surface of the photoreceptive member. Corona generating devices are well known, as described, for example, in U.S. Pat. No. 2,836,725, to R. G. Vyverberg, among numerous other patents and publications. In the referenced Vyverberg patent, the coronode is provided with a DC voltage, while the conductive shield is usually electrically grounded and the photoconductive surface to be charged is mounted on a grounded substrate, spaced from the coronode opposite the shield. Alternatively, the corona device may be biased in a manner taught in U.S. Pat. No. 2,879,395, wherein the flow of ions from the electrode to the photoconductive surface is regulated by an AC corona generating potential applied to the conductive wire electrode and a DC potential applied to the conductive shield partially surrounding the electrode. The DC potential allows the charge rate to be adjusted, making this biasing system ideal for self-regulating systems. Various other corona generating biasing arrangements are known in the art and will not be discussed in great detail herein.

Several problems have historically been associated with corona generating devices. The most notable problem centers around the inability of such corona devices to provide a uniform charge density along the entire length of the corona generating electrode, resulting in a corresponding variation in the magnitude of charge deposited on associated portions of the photoconductive surface being charged. Other problems include the use of very high voltages (3000–8000 V), requiring the use of special insulation, inordinate maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on the corona generating device. More importantly, corotron devices generate ozone, resulting in well-documented health and environmental hazards. Corona charging devices also generate oxides of nitrogen which eventually desorb from the corotron and oxidize various machine components, resulting in an adverse effect on the quality of the final output print produced thereby.

As an alternative to corona generating devices used in charging systems, roller charging systems have been developed and incorporated into various machine environments with limited success. Such roller charging systems are exemplified by U.S. Pat. No. 2,912,586, to R. W. Gundlach; U.S. Pat. No. 3,043,684, to E. F. Mayer; U.S. Pat. No. 3,398,336, to R. W. Martel et al.; U.S. Pat. No. 3,684,364, to F. W. Schmidlin; and U.S. Pat. No. 3,702,482, to Dolcimascolo et al., among others, wherein an electrically biased charging roller is placed in contact with the surface to be charged, e.g. the photoreceptive member. In this type of device, a charging member in the form of a roller is contacted with the surface of the photoreceptive member and an oscillating input voltage, typically a DC biased AC voltage signal, is applied to the roller to generate an oscillating electric field for applying a charge potential of a given polarity, to the photoreceptive member where the DC offset defines the polarity of the charge applied. Although the input voltage may be comprised solely of a DC component, an oscillating voltage such as, for example, an AC voltage signal having a DC voltage signal superimposed thereon has been found to be preferable with respect to charge uniformity.

The absence of charge uniformity tends to manifest itself in the from of periodic stripes or so-called strobing corresponding to the variation in charge potential on the photoconductive surface. This strobing effect causes variations in toner attraction during development and often results in significant image quality degradation. However, an oscillating input voltage contributes both positive and negative polarity charge to the photoconductive surface during the charging thereof. This results in a charging system that requires relatively high charging currents which, in turn, has a negative effect on the functional life of the photoreceptive member. Thus, a significant disadvantage of most biased roll charging systems is the resulting rapid wear of the photoconductive surface caused by the electrical discharge from the bias charge roll during the charging process.

The present invention relates to a biased roll charging apparatus having clipped AC input voltage which may reduce the phenomenon of strobing while also reducing photoreceptor wear caused by the electrical discharge from the bias charge roll during the charging process. The following disclosures may be relevant to various aspects of the present invention:

U.S. Pat. No. 5,412,455
Patentee: Ono et al.
Issued: May 2, 1995

U.S. Pat. No. 5,463,450
Patentee: Inoue et al.
Issued: Oct. 31, 1995

The relevant portions of the foregoing disclosures may be briefly summarized as follows:

U.S. Pat. No. 5,412,455 discloses a charging device including: a member to be charged; a charging member connectable to the member to be charged; a power source for supplying an oscillating voltage to the charging member; and a constant voltage element connected electrically in parallel with the power source for generating the oscillating voltage.

U.S. Pat. No. 5,463,450 discloses a charging apparatus for electrically charging a member to be charged including a charging member contactable to the member to be charged. The member to be charged includes a core and a voltage source for applying an oscillating voltage between the member to be charged and the charging member, wherein the frequency of the oscillating voltage satisfies a predetermined condition.

In accordance with the present invention, an apparatus for applying an electrical charge to a member to be charged is provided, comprising: a contact roll member situated in contact with a surface of the member to be charged; and means for applying an electrical bias to the contact roll member, the electrical bias including an oscillating voltage signal which is clipped to remove a selected polarity component thereof to supply a single polarity oscillating input drive voltage to the contact roll member, such that degradation and wear of the member to be charged is reduced by permitting reduced current flow to achieve a predetermined surface potential thereon.

In accordance with another aspect of the invention, an electrostatographic printing machine including a charging device for applying an electrical charge to an imaging member is provided, comprising: an apparatus for applying an electrical charge to a member to be charged, comprising: a contact roll member situated in contact with a surface of the member to be charged; and means for applying an electrical bias to the contact roll member, the electrical bias including an oscillating voltage signal which is clipped to remove a selected polarity component thereof to supply a single polarity oscillating input drive voltage to the contact roll member, such that degradation and wear of the member to be charged is reduced by permitting reduced current flow to achieve a predetermined surface potential thereon.

In accordance with another aspect of the invention, a method of applying a charge potential to an imaging member is provided, comprising the steps of: contacting a roll member to a surface of the imaging member to be charged; and applying an electrical bias to the contact roll member, the electrical bias including an oscillating voltage signal which is clipped to remove a selected polarity component thereof to supply a single polarity oscillating input drive voltage to the contact roll member, such that degradation and wear of the imaging member to be charged is reduced by permitting reduced current flow to achieve a predetermined surface potential thereon.

Figure 2:
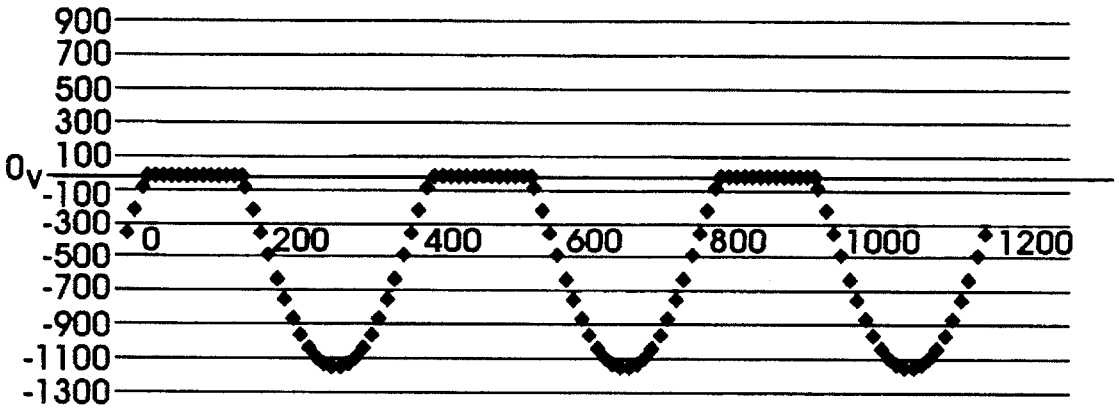
Figure 3:
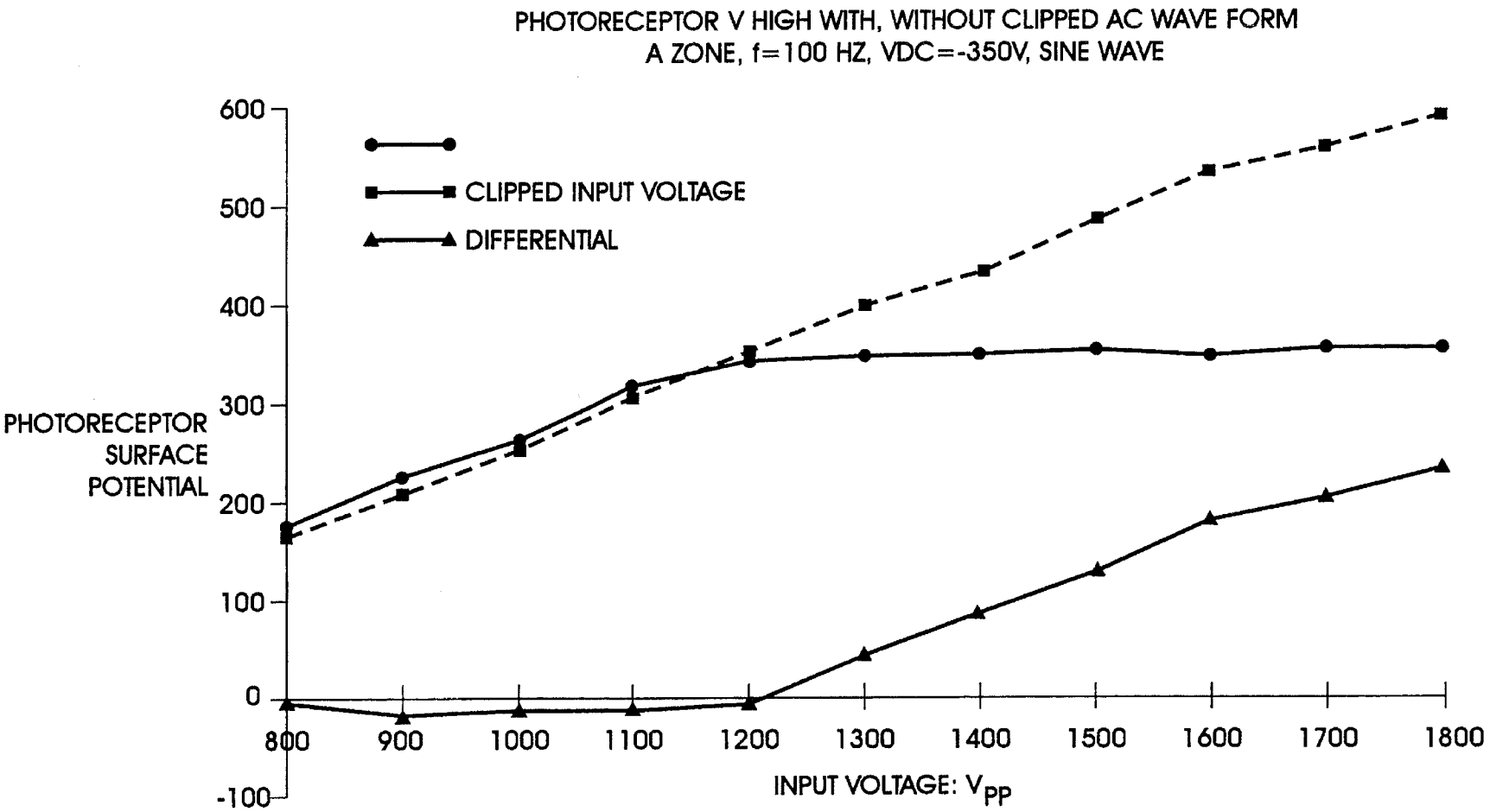

These and other aspects of the present invention will become apparent from the following description in conjunction with the accompanying drawings in which:

FIG. 1 is a partial schematic view of a biased roll charging system in accordance with the present invention and showing the electrostatic operation of the system;

FIG. 2 is a graphical representation of the clipped AC input voltage applied to the charging apparatus of the present invention; and FIG. 3 is a graphical representation of the surface potential differential that can can be achieved by the bias roll charging system of the present invention relative to a conventional bias charge roll charging system using a non-clipped oscillating input voltage signal.

For a general understanding of the features of the present invention, reference is made to the drawings wherein like reference numerals have been used throughout to designate identical elements. While the present invention will be described in connection with a preferred embodiment thereof, it will be understood that the invention is not limited to this preferred embodiment. On the contrary, the present invention is intended to cover all alternatives, modifications, and equivalents as may be included within the spirit and scope of the invention as defined by the appended claims.

In particular, it will be recognized, that while the present invention describes a charging system for a typical electrostatographic application, the instant charging structure is equally well suited for use in a wide variety of other electrostatographic-type processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems may also require the use of a charging device. In addition, it will be recognized that the instant biased roll charging system may have equal application for applying an electrical charge to a member other than a photoreceptor and/or in environments outside the realm of electrostatographic printing.

Referring initially to FIG. 1, a biased roll charging system in accordance with the present invention is shown in the context of an exemplary electrostatographic reproducing apparatus, employing a drum 12 including a photoconductive surface 35 deposited on an electrically grounded conductive substrate 38. A motor (not shown) engages with drum 12 for rotating the drum 12 to advance successive portions of photoconductive surface 35 through various processing stations disposed about the path of movement thereof, as is well known in the art. Initially, a portion of drum 10 passes through a charging station where a charging device in accordance with the present invention, indicated generally by reference numeral 10, charges the photoconductive surface on drum 12 to a relatively high, substantially uniform potential.

Referring now, more particularly, to the bias roll charging system 10, a conductive roll member 14 is provided in contacting engagement with the photoreceptor member 12. The conductive roll member 14 is axially supported on a conductive core or shaft 20, situated transverse to the direction of relative movement of the photoreceptor member 12. In a preferred embodiment, the roll member 14 is provided in the form of a deformable, elongated roller supported for rotation about an axis 16 and is preferably comprised of a polymer material such as, for example, Neoprene, F.P.D.M. rubber, Hypalon rubber, Nitrile rubber, Polyurethane rubber (polyester type), Polyurethane rubber (polyether type), Silicone rubber, Viton/Fluorel Rubber, Epichlorohydrin rubber, or other similar materials having a D.C. volume resistivity in the range of $10^3$ to $10^7$ ohm-cm after suitable compounding with carbon particles, graphite or other conductive additives. These materials are chosen for the characteristic of providing a deformable structure while in engagement contact with the photoreceptor member, as well as wearability, manufacturability and economy. The deformability of the roller member 14 is important to provide a nip having a substantially measurable width while being engaged with the photoreceptor 12.

A high voltage power supply 22 is connected to roll member 14 via shaft 20 for supplying an oscillating input drive voltage to the roll member 14. The oscillating input drive voltage is selected to have a peak-to-peak voltage based on the desired charge potential to be induced on the photoreceptor surface. While it is possible to use a standard line voltage, other voltage levels or voltage signal frequencies may be desirable in accordance with other limiting factors dependent on individual machine design, such as the desired charge level to be induced on the photoreceptor, or the speed of copying and printing operations desired.

With particular regard to biased roll charging, a suitable photoreceptive member 12 has the property of injecting a single sign of mobile carriers from a charge generating layer into a charge transport layer such that a surface charge potential having only a single charge polarity is generated on the surface of the photoreceptor member, irrespective of the inducing voltage signal applied to roll member 14. With reference to FIG. 1, the photoreceptive member 12 generally includes a grounded conductive substrate 38, such as an aluminum sheet connected to a ground potential 37, a charge generating layer 30, comprising a material such as gold or trigonal selenium, a charge transport layer 32 comprising a photoconductive insulator such as selenium or its alloys overlayed thereon, and a dielectric overcoating 34, forming the outer surface 35 of the photoreceptor member.

The charging operation involves the application of the A.C. voltage signal from the bias charging system 10 to the photoconductive surface of photoreceptor 12, which creates a voltage potential across the photoreceptor to ground 37. Charge carriers from the charge generating layer 32 migrate into the bulk of the charge transport layer 32 the upper surface 36 of the photoconductive material, where the charge will be trapped. When the A.C. voltage signal from voltage source 22 is of a negative polarity, as indicated by the minus signs (–) along the lowermost portion of roller member 14, in contact with the outer surface 35 of photoreceptor member 12, a positive charge indicated by plus signs (+) is induced near the upper surface 36 of the photoconductive material layer, suitable for charging the photoreceptor member in preparation for imaging. The thin dielectric overcoating 34 is desirable on either the roller member 14 or the photoreceptor 12 for a variety of reasons, including protection of the surfaces of roller member 14 or photoreceptor 12, or for a current limiting action which may allow the use of low resistivity rollers, or for photoreceptor or roll member surface property control, and especially because the use of an overcoating allows operation of the device below typical corona thresholds, and so avoids strobing due to exit corona, as will be discussed. In the embodiment shown in the drawings, overcoating 34 is provided on the upper surface of the photoreceptor. Alternatively, an overcoating may be provided on the outer surface of bias roll member 14 for the same effect.

Strobing, i.e. successive areas of varying voltage characteristics), has at least two causes. It can be caused by inducing a charge on a first photoreceptor surface portion by providing roller member 14 in contact with that portion during a period of the A.C. voltage signal passing through a selected polarity, while in a succeeding photoreceptor surface portion, inducing no charge because the A.C. voltage signal is passing through a period of non-selected polarity while roller member 14 is in contact with that portion of the photoreceptor surface. Accordingly, in order to provide a uniform charge on the photoreceptor surface, each incremental portion of the photoreceptor member surface must be contacted during a period of charging, or a period wherein the polarity of the driving voltage is of the selected polarity for charging. Thus, a given area of the rubber roller 14, the nip, should be maintained in contact with any selected surface portion for a period greater than the period of the driving voltage frequency. Varying nip widths may be provided by varying the materials used for the roller. In most cases, the allowable relative speed of the bias roller and the photoreceptor surface is varied in compensation for the varied nip width to prevent strobing. It will, of course, be appreciated that the time required for charging a photoreceptor to a given voltage level depends on the physics of the charge transfer process. In other words, the invention depends on the use of a photoreceptor where charging for a predetermined period is sufficient to charge the photoreceptor to a desired voltage level.

Strobing may also occur if the combination of induced and applied charges causes the field in the exit portion of the nip exceed the typical corona threshold. That is, in the area of the exit nip, air breakdown may occur, resulting in deposit of surface charges on the roller and the photoreceptor. The amount of surface charge will be modulated by the A.C. applied voltage. If this occurs, strobing may be eliminated by making the overcoating thicker or reducing the peak applied voltage.

As previously indicated, a typical bias charge roll system of the type described herein utilizes an AC waveform, typically having a DC offset, for charging a photoreceptor member to a required surface potential. The use of a DC offset AC waveform contributes both positive and negative charge to the photoreceptor member. However, since the photoreceptive member has the property of injecting only a single sign of mobile carriers from a charge generating layer to induce the generation of only a single charge polarity, a significant disadvantage of bias charge roll systems results from the fact that both negative and positive charge application results from an AC input drive voltage. This creates a requirement for a relatively high bias charge roll current which results in degradation and rapid wear of the photoreceptor charge transport layer due to the electrical discharge of the bias charge roller as the photoreceptor member is being charged. The present invention contemplates an approach for limiting the current required by a bias charge roll system without limiting the resulting surface charge potential and its uniformity by providing a single polarity oscillating input drive voltage supplied to the bias charge roller.

In a specific embodiment of the present invention, a simple diode/resistor circuit 26, 28 is coupled to the high voltage power supply 22 for eliminating the positive component of the DC offset AC waveform provided thereby. This diode/resistor circuit acts as a rectifier circuit for eliminating or clipping the positive component of the oscillating AC voltage signal. In an exemplary embodiment, a typical bias charge roll input drive voltage having a peak-to-peak voltage of 1.6 kilovolts with a DC offset of minus 350 volts at a frequency of 400 hertz will result in 450 volts of positive charge and 1150 volts of negative charge for delivering a photoreceptor surface potential of approximately minus 330 volts. By clipping the positive component of this typical AC input waveform, as shown in FIG. 2, this typical AC input voltage signal can increase the surface potential on the same photoreceptor to approximately 530 volts. Thus, by eliminating an unused component of the oscillating input voltage signal, current requirements of the bias charge roll system necessary to achieve required negative photoreceptor surface potentials can be significantly reduced. A negative surface charge potential is provided through the use of solely a negative input potential at the bias transfer roller 14, thereby eliminating excessive current flow to the surface of the photoreceptor which accelerates the degradation and wear of the charge transport layer thereof.

With reference to FIG. 3, it can be seen that the surface potential on the photoreceptor can be increased in relation to an increase in the peak-to-peak input voltage. In a conventional bias charge roll charging system using a non-clipped oscillating input voltage signal, the surface potential generated on the photoreceptor tends to level off (at approximately 350 volts in FIG. 3), notwithstanding the continued increase in peak-to-peak input voltage. By contrast, in accordance with the present invention, the surface potential generated by a bias charge roll charging system using a clipped oscillating input voltage signal continues to increase as a function of the peak-to-peak input voltage, such that the leveling off characteristic described above with respect to a non-clipped oscillating input voltage signal is eliminated. Thus, the present invention permits increased surface potential to be generated on the photoreceptor while allowing reduced current flow thereto as compared to a conventional bias charge roll charging system using a non-clipped oscillating input voltage signal.

It will be recognized by those of skill in the art that various oscillating input voltage signals can be utilized to provide the preferred results of the present invention. For example, the use of a square AC waveform has demonstrated improvements for photoreceptor charging, since a square AC waveform has a longer dwell time and higher current flow which results in more efficient photoreceptor charge application. It will be further recognized that the present invention may be utilized to provide a positive charge on the photoreceptor surface by clipping the negative component of the AC input voltage. In addition, the DC offset may be varied as desired to provide the specified photoreceptor surface potential.

In review, the foregoing description discloses an apparatus for applying an electrical charge to a photoreceptor wherein a bias contact roll member is situated in contact with a surface of the photoreceptor. The bias contact roll member is supplied with an electrical bias including an oscillating voltage signal having a DC offset with the oscillating voltage being clipped to remove a predetermined polarity component thereof.

It is, therefore, apparent that there has been provided, in accordance with the present invention, a biased roll charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An apparatus for applying an electrical charge to a member to be charged, comprising:

a contact roll member situated in contact with a surface of the member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the member to be charged is reduced by permitting reduced current flow to achieve a predetermined surface potential thereon.

2. The apparatus of claim 1, wherein the electrical bias applying means includes means for applying a DC offset to the oscillating voltage signal.

3. The apparatus of claim 1, wherein the member to be charged is a photoreceptive member having a photoconductive surface layer.

4. The apparatus of claim 1, wherein the oscillating voltage signal is in the form of a square waveform.

5. An apparatus for applying an electrical charge to a member to be charged, comprising:

a contact roll member situated in contact with a surface of the member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the member to be charged is reduced by permitting reduced current flow to achieve a predetermined surface potential thereon, wherein the electrical bias applying means includes:

a high voltage power supply for providing a DC offset AC voltage signal;

a diode element coupled to the high voltage power supply for preventing current flow associated with a positive component of the DC offset AC voltage signal; and a resistor element coupled between the diode element and a ground point for allowing current flow associated with a positive component of the DC offset AC voltage signal to flow to ground.

6. The apparatus of claim 5, wherein the high voltage power supply provides at least a 1.6 Kvolt AC voltage signal at a frequency of approximately 400 Hz and a DC offset of about −350 volts.

7. An apparatus for applying an electrical charge to a member to be charged, comprising:

a contact roll member situated in contact with a surface of the member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the member to be charged is reduced by permitting reduced current flow to achieve a predetermined surface potential thereon, wherein the electrical bias applying means includes:

a high voltage power supply for providing a DC offset AC voltage signal; and a rectifier circuit for preventing current flow associated with a positive component of the DC offset AC voltage signal.

8. An apparatus for applying an electrical charge to a member to be charged, comprising:

a contact roll member situated in contact with a surface of the member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the member to be charged is reduced by permitting reduced current flow to achieve a predetermined surface potential thereon, wherein the oscillating voltage signal is in the form of a sinusoidal waveform.

9. An electrostatographic printing apparatus including a charging device for applying an electrical charge to an imaging member, comprising:

a contact roll member situated in contact with a surface of the imaging member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the imaging member to be charged is reduced by permitting reduced current flow to achieve a predetermined surface potential thereon.

10. The apparatus of claim 9, wherein the electrical bias applying means includes means for applying a DC offset to the oscillating voltage signal.

11. The apparatus of claim 9, wherein the imaging member is a photoreceptive member having a photoconductive surface layer.

12. The apparatus of claim 9, wherein the oscillating voltage signal is in the form of a sinusoidal waveform.

13. The apparatus of claim 9, wherein the oscillating voltage signal is in the form of a square waveform.

14. An electrostatographic printing apparatus including a charging device for applying an electrical charge to an imaging member, comprising:

a contact roll member situated in contact with a surface of the imaging member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the imaging member to be charged is reduced by permitting reduced current flow to achieve a predetermined surface potential thereon, wherein the electrical bias applying means includes:

a high voltage power supply for providing a DC offset AC voltage signal;

a diode element coupled to the high voltage power supply for preventing current flow associated with a positive component of the DC offset AC voltage signal; and a resistor element coupled between the diode element and a ground point for allowing current flow associated with a positive component of the DC offset AC voltage signal to flow to ground.

15. The apparatus of claim 14, wherein the high voltage power supply provides at least a 1.6 Kvolt AC voltage signal at a frequency of approximately 400 Hz and a DC offset of about −350 volts.

16. An electrostatographic printing apparatus including a charging device for applying an electrical charge to an imaging member, comprising:

a contact roll member situated in contact with a surface of the imaging member to be charged; and means for applying an electrical bias to said contact roll member, the electrical bias including an oscillating voltage signal which is clipped to remove a selected polarity component thereof to supply a single polarity oscillating input drive voltage to said contact roll member, such that degradation and wear of the imaging member to be charged is reduced by permitting reduced current flow to achieve a predetermined surface potential thereon, wherein the electrical bias applying means includes:

a high voltage power supply for providing a DC offset AC voltage signal; and a rectifier circuit for preventing current flow associated with a positive component of the DC offset AC voltage signal.

17. A method of applying a charge potential to an imaging member, comprising the steps of:

contacting a roll member to a surface of the imaging member to be charged; and applying an electrical bias to said contact roll member, the electrical bias including an oscillating voltage signal which is clipped to remove a selected polarity component thereof to supply a single polarity oscillating input drive voltage to said contact roll member, such that degradation and wear of the imaging member to be charged is reduced by permitting reduced current flow to achieve a predetermined surface potential thereon.

18. The method of claim 17, wherein said step of applying an electrical bias to said contact roll member includes the step of applying a DC offset to the oscillating voltage signal.

* * * * *